US009072643B2

(12) United States Patent
Hines

(10) Patent No.: US 9,072,643 B2
(45) Date of Patent: Jul. 7, 2015

(54) DEVICE, SYSTEM AND METHOD FOR TRANSFERRING A PERSON FROM A HORIZONTAL TO A SITTING POSITION OR VICE VERSA

(71) Applicant: Andrew Hines, Boonton, NJ (US)

(72) Inventor: Andrew Hines, Boonton, NJ (US)

(73) Assignee: Starship Enterprises, LLC, Boonton, NJ (US)

( * ) Notice: Subject to any disclaimer, the term of this patent is extended or adjusted under 35 U.S.C. 154(b) by 209 days.

(21) Appl. No.: 13/674,094

(22) Filed: Nov. 11, 2012

(65) Prior Publication Data

US 2013/0134757 A1 May 30, 2013

Related U.S. Application Data

(60) Provisional application No. 61/558,729, filed on Nov. 11, 2011.

(51) Int. Cl.

| | |
|---|---|
| ***A61G 5/14*** | (2006.01) |
| ***A61G 5/00*** | (2006.01) |
| ***A61G 7/053*** | (2006.01) |
| ***A61G 7/16*** | (2006.01) |
| *A61G 5/10* | (2006.01) |
| *A61G 7/10* | (2006.01) |
| *A61G 5/12* | (2006.01) |

(52) U.S. Cl.

CPC *A61G 5/14* (2013.01); *A61G 5/006* (2013.01); *A61G 5/1059* (2013.01); *A61G 7/053* (2013.01); *A61G 7/1019* (2013.01); *A61G 7/1048* (2013.01); *A61G 7/1076* (2013.01); *A61G 7/16* (2013.01); *A61G 2005/125* (2013.01); *A61G 2200/32* (2013.01); *A61G 2200/34* (2013.01); *A61G 2203/12* (2013.01); *A61G 2203/14* (2013.01)

(58) Field of Classification Search

CPC . A61G 5/14; A61G 7/053; A61G 2200/0034; A61G 7/16

USPC ..... 297/DIG. 10, 331, 217.7

See application file for complete search history.

(56) References Cited

U.S. PATENT DOCUMENTS

| | | | | | |
|---|---|---|---|---|---|
| 4,183,109 | A | * | 1/1980 | Howell | 297/DIG. 10 |
| 4,407,543 | A | * | 10/1983 | Mashuda | 297/DIG. 10 |
| 4,752,100 | A | * | 6/1988 | Lemaire | 297/DIG. 10 |
| 5,095,561 | A | * | 3/1992 | Green et al. | 297/DIG. 10 X |
| 5,261,725 | A | * | 11/1993 | Rudolph | 297/DIG. 10 |

* cited by examiner

*Primary Examiner* — Anthony D Barfield

(74) *Attorney, Agent, or Firm* — Volpe and Koenig, P.C.

(57) ABSTRACT

A device, system and method for assisting an elderly, disabled, or infirmed person to rise from a lying or substantially lying position, at or near floor level, to at least a sitting position with minimal or no assistance from another person. The device may be, at its lowest or substantially most compressed position, low enough to be accessible to a person lying at or near floor level who may have very limited mobility due to age, a disability, or an infirmity. The device, system and method may additionally provide a secondary mode, and/or an optional aspect of the device, for moving the person once in the seated position to a standing position using the device.

5 Claims, 8 Drawing Sheets

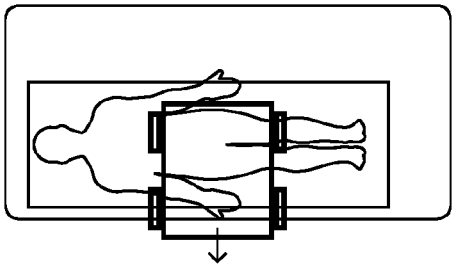
FIG. 6A Person 'boards' sit assist
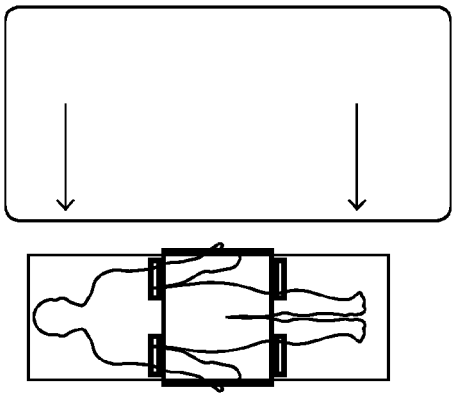
FIG. 6B Sit assist chair exits from under bed to bedside
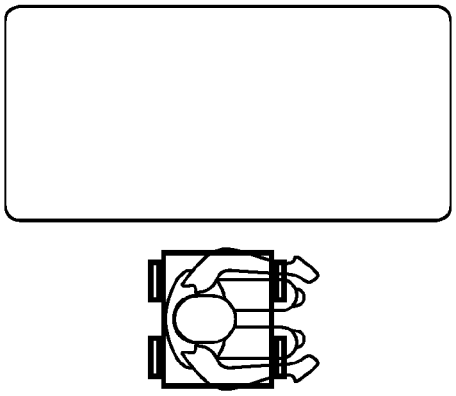
FIG. 6C Sit assist operates from PRONE to SEATED
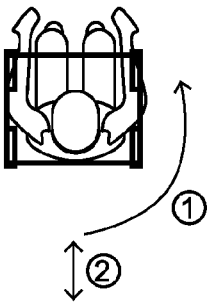
FIG. 6D ① Sit Assist chair rotates 90 degrees
② for normal travel.

DEVICE, SYSTEM AND METHOD FOR TRANSFERRING A PERSON FROM A HORIZONTAL TO A SITTING POSITION OR VICE VERSA

CROSS REFERENCE TO RELATED APPLICATIONS

N/A.

BACKGROUND

1. Field of the Invention

The instant invention relates to the field of mechanical lifting devices, and in particular to a device, system and method for transferring person from a substantially horizontal position to an at least partially vertical position or vice versa.

2. Background of the Invention

Elder care, deinstitutionalized living, and independent living for the handicapped are all thriving industries in the United States and across the world. Unfortunately, as humans age or become infirm, mobility and ambulation becomes increasingly difficult, and the ability to take care of oneself often likewise fades. Nevertheless, a great many elderly persons are capable of taking care of themselves, but may on occasion, require assistance. This is similarly true of many disabled or infirmed persons, or persons in need of physical therapy, and the like.

For example, many products are provided to assist the elderly, disabled, or infirmed (also referred to collectively herein as "elderly") in their own private residences, or in independent living, assisted care or nursing home environments. As these terms are used herein, a private home or residential environment is defined to include a person's private residence; an independent living environment is defined to include a living environment dedicated to elderly persons capable of living, for the most part, on their own; an assisted living environment is defined to include an environment in which the elderly are capable of living at least partially on their own, but may occasionally, or frequently, require assistance; and a nursing care environment is defined to include an environment in which an elderly person is no longer capable of living on his or her own. Further, an assisted living environment might include an in- or out-patient rehab facility, a hospital, or the like.

The aforementioned assistive products provided to assist in these types of environments may include, by way of non-limiting example, products that can help an elderly person at least partially support his or her weight, and/or that can assist an elderly person in calling for assistance when needed. By way of non-limiting example, such products may include: an emergency bracelet, necklace, or the like capable of dialing 911 on behalf of the elderly person; bathing and/or body cleaning equipment, such as handholds, bath lifts, shower seats, hand-held reaching devices, supports, and foot drying assistance; and assistive measures for use of the toilet, and the like. Assistive products, such as those that assist to transfer or otherwise move the elderly, that are typically more available to those elderly persons requiring greater amounts of assistance may include a crane-type lift, such as for patient lifting and water therapy, a bath lift, a toilet assist, a bedside lift, a mobility device such as a scooter, wheelchair, or the like, or a human care-giver.

However, none of these products or prior-art embodiments is capable of assisting an elderly person with one of the most frequent occurrences in elder care or self care—namely, assisting an elderly person who has fallen or is otherwise placed on the floor, and is unable to lift his or her own weight to get back off the floor. Although very frequently in such situations the elderly person on the floor is uninjured, nevertheless, a call to 911 is typically placed. This may be for example, because the elderly person is unable to reach a chair to support his or her weight in a private residence; an elderly person in an independent living situation is not to be assisted off the floor by resident personnel; or there is risk of injury to resident personnel in an assisted care or nursing environment, for example. Consequently, the uninjured elderly person on the floor is often subject to arrival of emergency medical personnel, embarrassment, or worse yet, time spent alone on the floor due to a lack of desire or ability to call 911, during such occurrences. Needless to say, such solutions, or the lack of solutions, increase not only the expense and time to solve the elderly person's placement on the floor, but additionally unnecessarily increase the stress level of the subject elderly person. Those skilled in the art will appreciate that increased stress, in and of itself, can have an adverse effect on the general health of an elderly person. Thus, much appreciation must target minimizing risk to caregivers and/or assistants, whether in an in-home or an institutional environment.

Therefore, the need exists for a device that operates at floor level, that is accessible to an elderly person and/or a caregiver, and that is capable of transferring and/or lifting a non-critically injured elderly or disabled person off the floor to at least a seated position or vice versa.

SUMMARY OF THE INVENTION

The present invention is and includes a device, system and method for assisting an elderly, disabled, or infirm person to rise from a lying or substantially lying position, at or near floor level, to at least a sitting position without lifting assistance from another person. In particularly preferred embodiments, the device may be, at its lowest or substantially most compressed position, low enough to be accessible to a person lying at or near floor level who may have very limited mobility due to age, a disability, or an infirmity. The device may additionally provide a secondary mode, and/or an optional aspect of the device, for moving the person once in the seated position to a standing position using the device.

By way of non-limiting example, the device, system and method for raising a user from a substantially horizontal, substantially floor level position to at least a seated position may include a substantially stable base having a profile in the range of less than 6 inches above floor level and an upper frame having at least a portion thereof movably mounted atop said base, and having a compressed profile in the range of less than 9 inches above the floor level. The present invention may further include at least one actuator capable of raising, solely responsive to actuation by said actuator, at least the lowermost portion and the backrest portion to positions substantially perpendicular to a length of the base. Further, the upper frame may include a lower most portion capable of accommodating an area of legs of the user, a seat portion capable of at least partially accommodating a bottom of the user, and rotatably associated across at least a portion of a length of the seat portion with an adjacent length of the lowermost portion, and a backrest portion capable of at least partially accommodating a back of the user, and rotatably associated across at least a portion of a length of the backrest portion with an adjacent length of the lowermost portion laterally opposite the lower most portion.

Thus, the present invention provides a device, system and method that operates at/or about at floor level, that is accessible to an elderly person with or without the aid of a caregiver, and that is capable of lifting/transferring/repositioning a non-critically injured elderly or disabled person off the floor to at least a seated position.

BRIEF DESCRIPTION OF THE FIGURES

Understanding of the present invention will be facilitated by consideration of the following detailed description of the embodiments of the present invention taken in conjunction with the accompanying drawings, in which like numerals refer to like parts and in which:

FIGS. 6A, 6B, 6C and 6D are schematic illustrations of aspects of the present invention.

DETAILED DESCRIPTION

It is to be understood that the figures and descriptions of the present invention have been simplified to illustrate elements that are relevant for a clear understanding of the present invention, while eliminating, for the purpose of clarity, many other elements found in typical mechanical lifting devices, systems and methods. Those of ordinary skill in the art will thus recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art. Furthermore, the embodiments identified and illustrated herein are for exemplary purposes only, and are not meant to be exclusive or limited in their description of the present invention.

The present invention is and includes a device capable of assisting an elderly, disabled, or infirm person (hereinafter "elderly person") to rise from a lying or substantially lying position, at or near floor level, to at least a sitting position without lifting assistance, or with only minimal assistance, from another person. In particularly preferred embodiments, the device may be, at its lowest or substantially most compressed position, low enough to be accessible to a person lying at or near floor level who may have very limited mobility due to age, a disability, or an infirmity. The device may be self-powered and/or supplied with power sufficient to allow the device to expand, rise or otherwise decompress in order to lift a quantity of weight equivalent to at least an average person were that person to lie on the device. The device may preferably rise to at least the level of a chair, so as to assist the lying person in reaching at least a sitting position. The device may additionally provide a secondary mode, and/or an optional aspect of the device, for moving/assisting/repositioning/transferring the person once in the seated position to a standing position using the device.

Figure 1A:
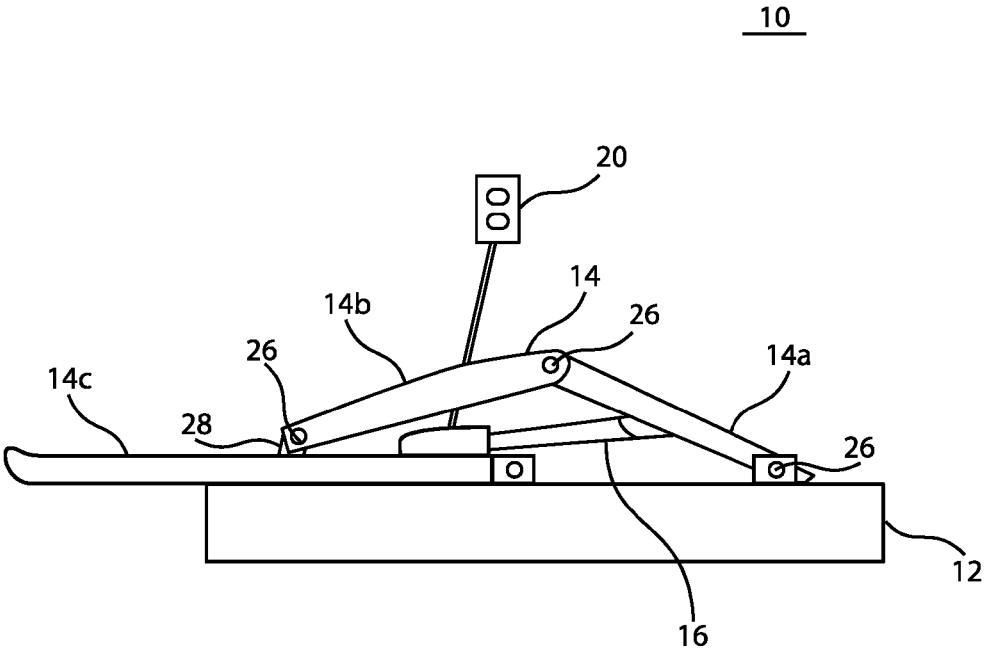
FIG. 1A is an exemplary illustration of a mechanically actuatable raising device in accordance with the present invention.
Figure 1B:
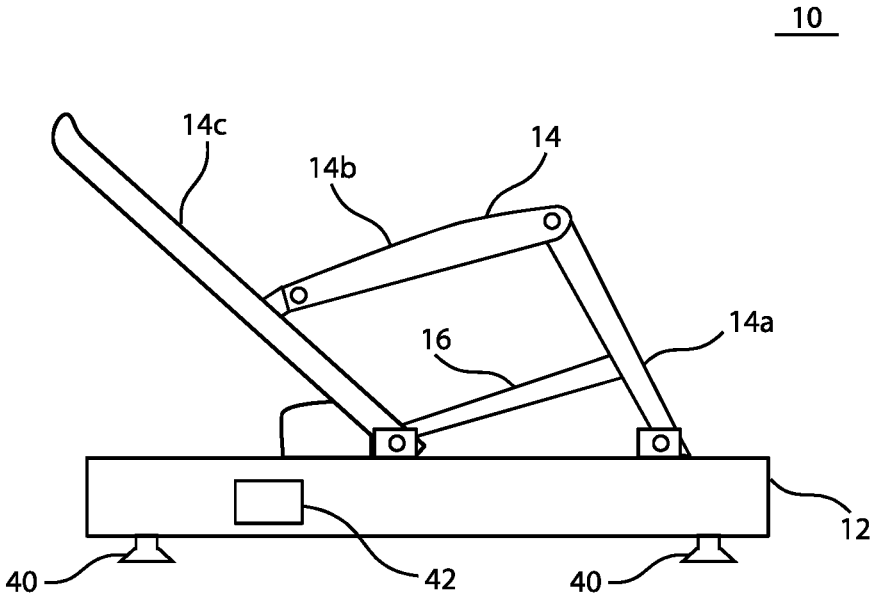
FIG. 1B is an exemplary illustration of a mechanically actuatable raising device in accordance with the present invention.

As illustrated in FIGS. 1A and 1B, an exemplary embodiment of the device 10 may include a substantially stable base 12, a convertible upper frame 14, and at least one lift mechanism/actuator 16 for actuating the upper frame atop the base. At the low or compressed position (FIG. 1A illustrates an early stage decompressed position, and FIG. 1B illustrates a later stage decompressed position), the 10 device is preferably flat enough and low enough to allow a disabled person lying at the floor level to roll onto the device. In a preferred embodiment, the device may include a controller 20, such that when the person rolls onto the device and is faced upward, the person can actuate controller 20 to cause the actuation of at least a portion of the upper frame 14 away from the base 12, whereby the previously flat upper frame may ultimately be mechanically converted into at least a chair shape so as to assist the person on the device to a seated position.

As such, the present invention provides a device 10 that operates at or substantially at floor level, and that allows a person placed at floor level who is not critically injured to rise to at least a seating position. The device 10 so provided is user-friendly, at least in that it is reachable to a person on the floor and simple to use by use of controller 20, and the device preferably provide the necessary weight support and construction of base 12, upper frame 14, and actuator 16 to safely lift the person to a seated position.

Moreover, the device may, in certain embodiments, store flat and minimize the risk of injury to professional staff, emergency medical personnel, or the like. Further, the device of the present invention may lower ambulance and other healthcare costs, and may lower aid service costs, response times, independent living or private resident needs, and the like. Yet further, the present device expands available therapies for the injured, disabled or infirm, at least in that therapies can be performed at floor level, without need of having the therapist lower or lift the injured, disabled or infirm party down to, or up from, the floor level during therapy. The patient is thereby enabled to self-lower to the floor, such as for exercise and the like. As such, the present invent may be for use by the elderly, the permanently disabled, the temporarily disabled, the infirm, the wounded (such as amputees), and the like.

More particularly, and with respect to the exemplary embodiment of FIGS. 1A and 1B, the device may include the aforementioned base 12, the actuator 16 and the actuatable upper frame 14. More particularly, the upper frame may include, by way of non-limiting example, a series of knuckles, slide bolts, hinge bolts, or hinges, hinges, or the like 26, and/or one or more scissor hinges, mechanical slides, or the like 28. For example, upon actuation of upper frame 14, one or more of the hinge bolts 26 may rotate through a rotational circumferential pursuant to the actuation by actuator 16, and one or more of the scissor hinges 28 may correspondingly, such as pursuant to actuation of the one or more hinge bolts 26, slide from a first position to a second position. Thereby, upon actuation by the actuator 16, the knuckles 26 and slides 28 of the upper frame 14 may operate to slowly, safely and substantially linearly bring the upper frame from a flat or compressed position to generate at least a seated position for a person initially at floor level and lying upon the upper frame.

The one or more actuators 16 may be any actuator known to those skilled in the art capable of actuating the upper frame, with the weight of the person thereupon, from a substantially flat position to at least a seated position. In an exemplary embodiment, the actuator is comprised of a single actuator/motor, although those skilled in the art will appreciate that multiple actuators may be used. In the illustrated embodiment, the actuator is a motorized extending arm that is extended outwardly from a base unit of the actuator towards a lower portion of the upper frame, or from the left to the right in the provided illustration of FIGS. 1A and 1B, such that a hinge bolt 26 between the lower most portion 14*a* of the upper frame and the seat portion 14*b* of the upper frame is partially rotated, which rotation, in conjunction with a scissor hinge 28 and hinge bolt 26 at the seat portion 14*b* of the upper frame at a location opposite the lower most portion of the upper frame, causes the lower portion of the seat portion 14*b* to rise from the base 12, and thus causes that portion of the lower most portion 14*a* of the upper frame closest to the seat portion 14*b* to also rise at an increasing angle from the base 12.

In the illustrated embodiment, once the maximum actuation of the hinge bolt in the seat portion 14*b* at the location opposite the lower most portion 14*b* of the upper frame has occurred, the force of the actuator 16 against the lower most portion 14*a* will cause the seat portion 14*b* in its entirety to begin to rise from the base, which, if there is a stop in the hinge bolt rotation provided in the seat portion hinge bolt 26 associated with the scissor hinge 28, will cause the backrest portion 14*c* of the upper frame to begin to rise as the seat portion 14*b* rises, at least partially due to the force of the continued action of the actuator 16. Thereby, following substantially complete actuation of the actuator from left to right in the illustration, the upper frame will have reached a position such that the back-rest portion 14*c* of the upper frame is substantially perpendicular to the base 12 of the device, the seat portion 14*b* of the upper frame is at least substantially parallel to the base 12 of the device, and the lower most portion 14*a* of the upper frame is at least substantially perpendicular to the base 12 of the device.

As such, it is anticipated that, by countermovement of the backrest portion and the lower most portion, the center of gravity and balance-point may remain substantially located at or about the seat portion. Accordingly, those skilled in the art will appreciate, in light of the discussion herein with respect to the upper frame, that hinges, scissor hinges, mechanical slides, or the like, other than those particularly illustrated in FIGS. 1A and 1B, may be mechanically employed in accordance with the disclosure herein without varying from the spirit and scope hereof. Further, those skilled in the art will appreciate that the actuation by the exemplary single actuator discussed with respect to FIGS. 1A and 1B is also merely illustrative, and that any manner of actuation of the upper frame may be performed wherein, preferably, a slight angle is first imparted at approximately the knee location of the person placed on the upper frame, whereafter the seat may be slightly lifted, and whereafter the angle between the shoulders and the midsection of the person on the device may be slowly and substantially linearly decreased, as is the angle formed by the upper and lower leg at the back of the knee of the person on the device.

Further, those skilled in the art will appreciate, in light of the discussion herein, that, after actuation to a seated position, a portion of the seat frame may further assist the person from the seated position to a standing position, correspondent to further actuation of the one or more actuators. Such assistance of the person from the seated position to the standing position may occur only upon further actuating of the controller 20 by the person initially laying on the device or the person's attendant, by way of non-limiting example.

The base 12 in the illustrative diagram of FIGS. 1A and 1B may preferably be sufficiently stable so as to support the upper frame 14 and actuator 16 during actuation and with the weight of a person atop the base. As such, while the base 12 may have wheels and/or casters on its underside, such as to allow for the device to be moved in and out from underneath, for example, furniture, or the base 12 may have a track associated with its underside to allow the base to be moved in and out from underneath, for example, furniture, the track or the wheels are preferably mechanically overridden, such as by a locking mechanism, extendable leg portions, suction cups, or the like, (hereinafter "locking mechanism" 40), such that the base 12 becomes fully stable immediately upon or soon after activation of the controller 20 instructing actuation of the device 10.

The base 12 may be constructed to allow easy portability and/or movement, such as in embodiments comprising a lightweight base formed of a plastic or the like, or the base may be formed of heavier material such as to impart additional structural integrity and/or stability to increase the stationary nature of the device, such as wherein the device is formed of heavier weighted metals. Further, the base 12 may provide a power source location 42 for the power provided to the one or more actuators and or to the one or more tracks that may slide the device 10 from underneath, for example, furniture. For example, the base may provide a location for a battery 42, along with one or more electrical inputs to allow charging of the battery such as from a wall socket. Likewise, the base may simply provide an electrical input for use with a household plug, for example.

Those skilled in the art will appreciate that a variety of optional components may be provided in conjunction with those discussed above. For example, the one or more actuators may cause, as the seat rises of the upper frame, a "cradle" effect, such as whereby wings (not shown) on the left most and right-most portion of the seat portion 14*b* may be angled or otherwise extended upwardly during actuation such that the bottom of a person resting on the seat is cradled to provide additional stability as the upper frame rises. Further, a seat-belt (not shown) may be provided on the seat portion, particularly in non-residential and/or institutional embodiments, to provide further safety measures for device 10. Yet further, handles (not shown) may be provided, such as on the seat portion 14*b*, in order to further stabilize the person while laying or seated on the upper frame.

Further, the construction of aspects of the device 10, and the portions thereof, may vary, and the appearance of the device may vary in accordingly with its construction. For example, padding may or may not be available, particularly in conjunction with the seat portion 14*b* and the back-rest portion 14*c* of the upper frame. Moreover, as mentioned above the upper frame 14 may be lightweight, strong, durable, and capable of a low profile in a compressed state, irrespective of the weight and preferred low profile of the base 12.

Additionally, the device, and particularly the control indicated by the aforementioned controller 20, may be configurable, such wherein the device 10 is controlled so as to raise only to a seated position, or to a standing position, wherein the rate of rise of the upper frame from the base may be varied, or the like. The configurable nature of the present invention may vary in accordingly with the actuation methodology employed, such as in accordance with the use of linear motion, scissor hinges, a worm screw actuator, or the like.

Thus, as discussed in the illustrative embodiments with respect to FIGS. 1A and 1B, it may be preferable to minimize the profile and/or usable floor footprint of the device 10. This may be further accomplished by creating a bendable backrest, an ultra-thin but sturdy upper frame, or by like methodologies. This may further be accomplished through additional and alternative embodiments of the device, such as embodiments that are not stored under furniture. For example, FIG. 2 illustrates device 10 that may be wall 110 adjacent and/or wall-mounted, whereby stability may be imparted to the upper frame 14 by an independent base 12, or wherein the device may be baseless and instead use a wall mount extension base 112, or other embodiments that provide stability that will be apparent to those skilled in the art in light of the discussion herein.

Figure 2:
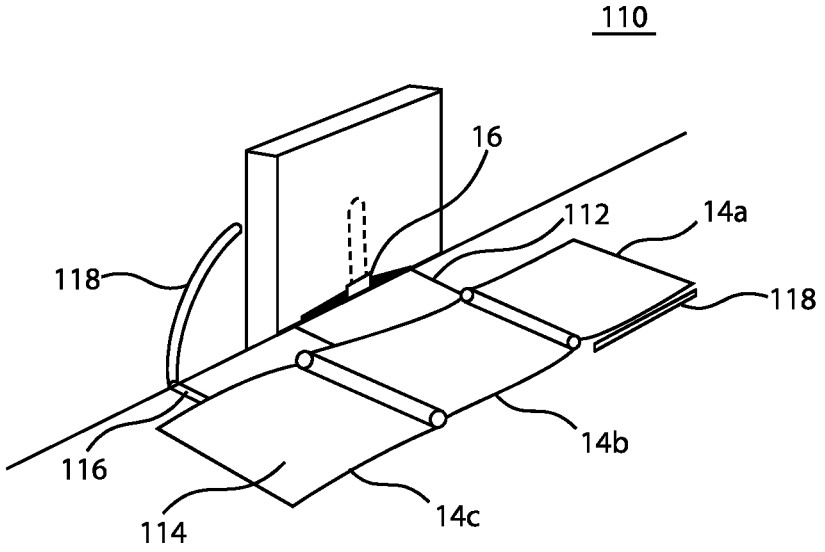
FIG. 2 illustrates an exemplary embodiment of a mechanically actuatable raising device in accordance with the present invention.

As illustrated in FIG. 2, one or more actuators may be placed within or on the wall-mount, whereby actuation of the one or more actuators 16 may raise the upper frame 14 as discussed herein above with respect to FIGS. 1A and 1B. In an exemplary embodiment of FIG. 2, a single actuator 16 may raise the wall-mount base 112, wherein the wall-mount base 112 may provide an extended base portion underneath the seat portion 14*b* of the upper frame 14. Further, as the single actuator 16 acts to lift the seat portion 14*b*, an extended arm 116 behind the back-rest portion 14*c* may have, extending therefrom into mechanical association with the actuator, a chain, slide, or rope portion 118, wherein the upward actuation of the base extension 112 by the actuator 16 may actuate extended arm 116 along the slide or like wall-mounted guide, the chain 118, wherein this actuation pulls the back-rest portion 14*c* forward and upward as the seat portion 14*b* of the upper frame is raised.

Figure 3:
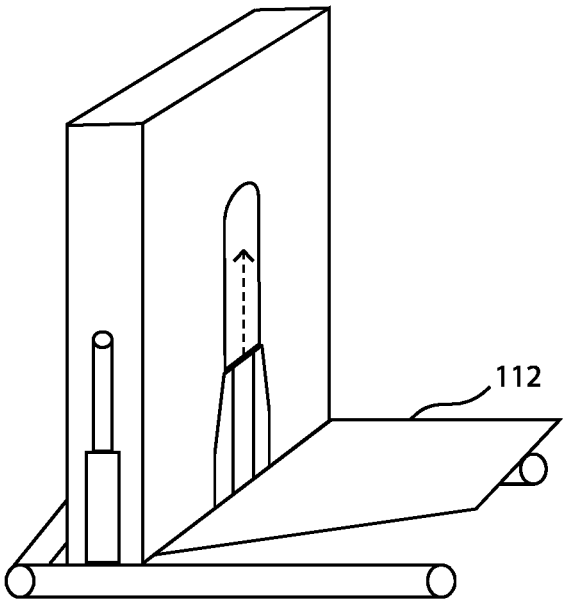
FIG. 3 is a diagram illustrating an exemplary embodiment of a mechanically actuatable raising device in accordance with the present invention.

FIG. 3 illustrates with greater particularity a die lift 112 system in accordance with exemplary embodiments, such as that of FIG. 2. In the exemplary embodiment of FIG. 3 (and/or in the wall mount embodiment of FIG. 2), those skilled in the art will appreciate that the illustrated lifting mechanism may be, for example, recessed into a wall or a furniture cabinet in order to obtain the space savings that may be similarly provided by sliding the device of the exemplary embodiment of FIGS. 1A and 1B under a piece of furniture. In an exemplary lift such as that shown in FIG. 3, the sides of the device can be minimized in order to achieve greater floor area space savings, such that the wall adjacent portion of the lift may extend, for example, approximately 16 inches upward along the wall, and the wall mount portion may be, for example, approximately 13.5 inches wide such that it may fit in a recess between wall studs in a typical household wall.

Of course, those skilled in the art will further appreciate that, in alternative embodiments, casters or similar devices, such as in conjunction with mechanical slides, may be placed at the base of, for example, backrest portion 14*c* and lower most portion 14*a*, such as at the point(s) where the assist device meets base 12. Thereby the frame, for example, may be lifted off the floor, such as by insertion of the casters through slots in base 12 against a floor. Further, the extension of such casters may allow for mobility of the base, even with the device in the seated position atop the base.

Figure 4:
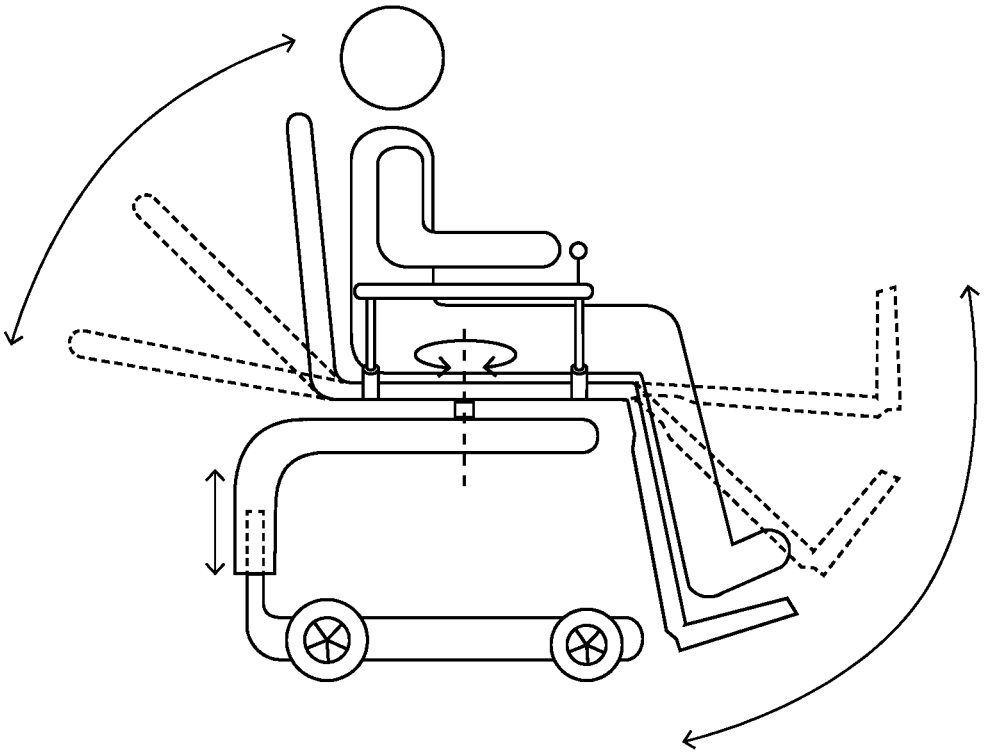
FIG. 4 is a schematic illustration of aspects of the present invention.
Figure 5A:
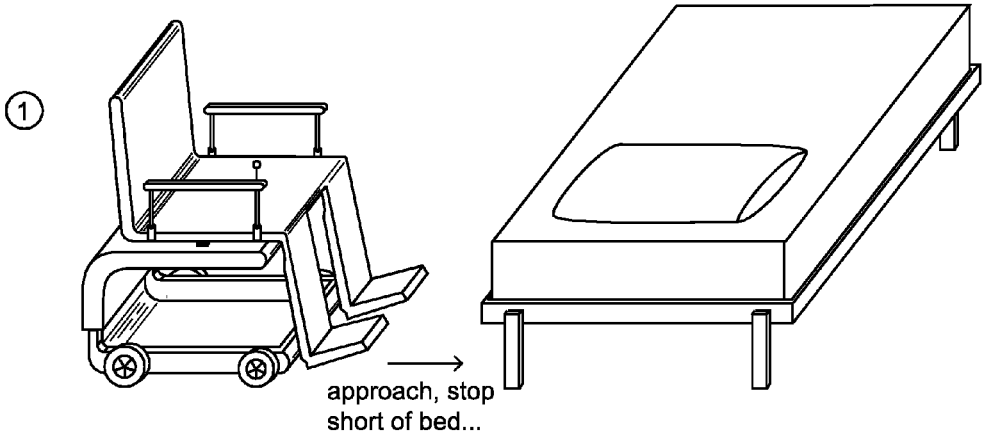
FIGS. 5A, 5B, and 5C are schematic illustrations of aspects of the present invention.
Figure 5B:
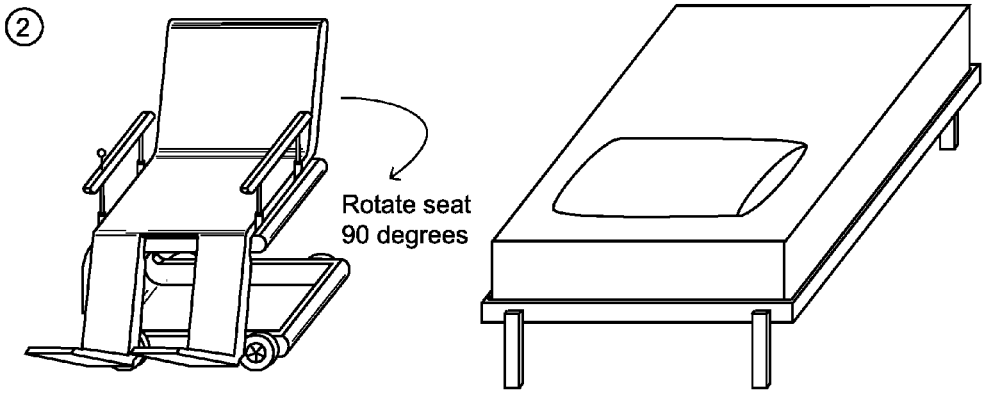
Figure 5C:
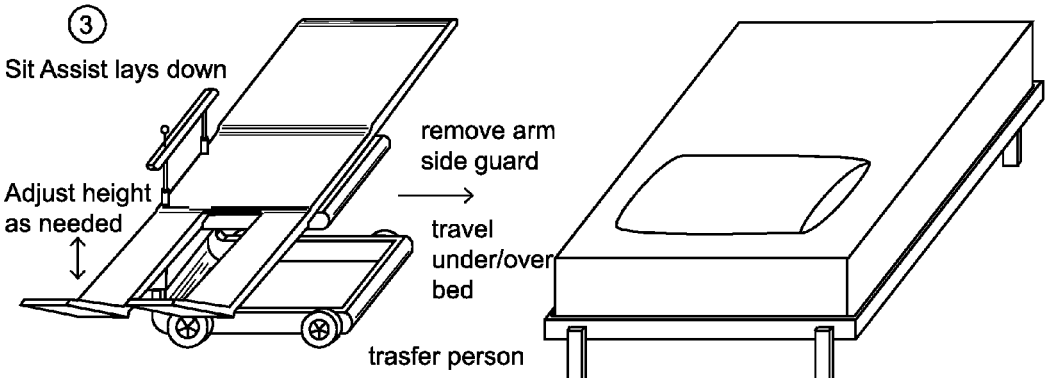

For example, in an additional alternative embodiment of a raised seat atop a base and as illustrated in FIG. 4, the patient transfer device may be fitted to, or perform as, a specialized wheelchair. As shown, the wheelchair may be designed atop a "C"-type frame 502 having an open front portion 504. Such a frame may permit entry over or under a bed, bench, or desk 506, by way of non-limiting example, such as to allow the person within the wheelchair to mount or dismount between the device and an adjoining surface with no, or minimal, assistance, or to approach a chair or other seating device, such as a toilet, In operation, and as illustrated in FIGS. 5A, 5B and 5C and in the top views of FIGS. 6A, 6B, 6C and 6D, the wheelchair may approach a target substantially directly with the open portion of the C-frame most proximate to the target. Thereafter, the device may be activated so as to swivel, rotate, or the like, as needed in order to effectively align the body of the person in the wheelchair at a suitable angle to dismount onto, or be suspended over, the target. In the illustrated example, the device is rotated 90 degrees about the C-frame.

The wheelchair may then be activated to change position as necessary, such as from sitting to a prone position if the user is to dismount onto a bed, for example. Upon reaching the proper rotation and position with respect to the target, the open portion of the C-frame may enter the target area, such as to suspend a prone person above the target, or to place the seated person over a toilet bowl. Needless to say, a user of the wheelchair may change the elevation of the seat portion 14, and/or the height of the C-frame, as is necessary to accommodate the height of the target.

The user may then transfer to the target as needed, such as with no or minimal assistance from a third party. To the extent the user has left the chair and dismounted to the target, the chair may back away from the target but maintain a proximate position to allow for reboarding of the user from the target back onto the wheelchair. Of course, as referenced above, in certain embodiments, such as wherein a toilet is the target, the user may not dismount from the wheelchair.

By way of more particular example, the wheelchair may approach the toilet, and the chair atop the C-frame may rotate 180 degrees from a position wherein the user is facing the open portion of the C-frame. Thereby, the wheelchair may be positioned such that, upon advancing, at the direction of the user, in the direction of the opening of the C-frame, the seat portion of the chair straddles the toilet seat to permit toileting by the user. Of course, those skilled in the art will appreciate, that, in such an embodiment, the C-frame on which the wheelchair resides will preferably not have cross-members, or the like, that would bar straddling of a toilet. Further, in such embodiments, it may be preferred that the seat portion of the wheelchair be hollowed at its center, such as in an oval shape sufficient to accommodate toileting of the user atop the seat portion of the wheelchair. Moreover, the seat portion may be at least partially constituted of a large diameter "lazy Susan"-type rotator/bearing having a hollow center, or, by way of additional example, may be constituted of a flat seat surface upon a series of ball bearings. In each such embodiment, it is preferred that any opening in the seat portion pass through the underlying device that enables rotation, to thereby enable toileting of the user.

Figure 7:
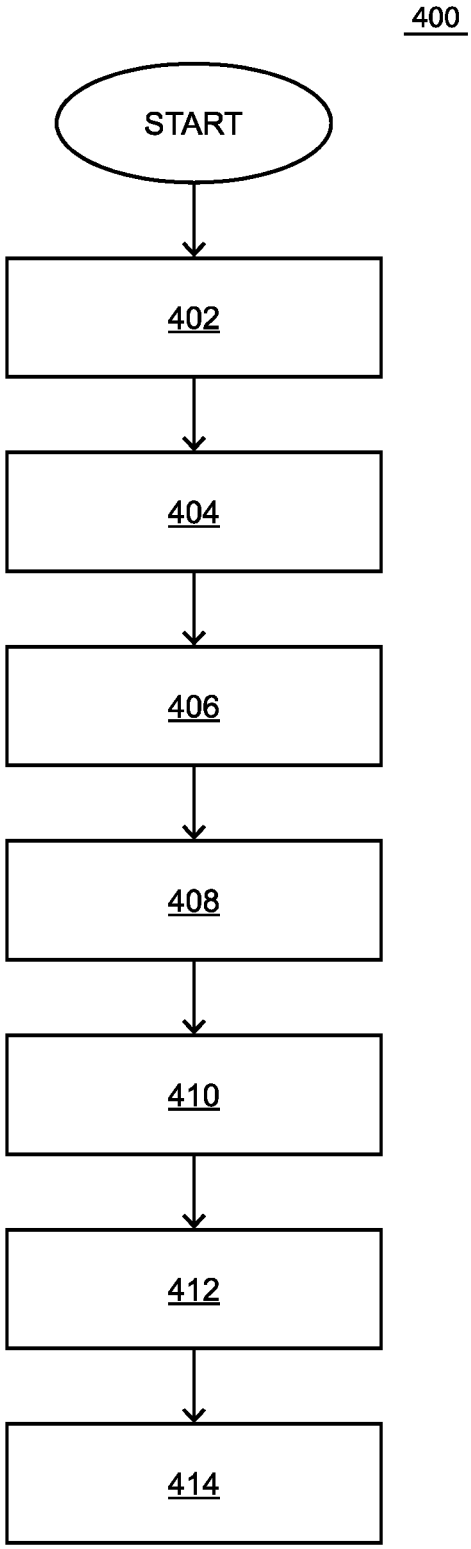
FIG. 7 is a flow diagram illustrating an exemplary method of raising a person from floor level in accordance with the present invention.

FIG. 7 is a flow diagram illustrative of an exemplary method of using device 10 in accordance with the present invention. In the illustrated method 400, at step 402 a floor level lift system is provided. At step 404, a user instruction is received to actuate the floor level system. At optional step 406, the actuation instruction may not be executed until confirmation, such as via electrical sensing, that the user is properly on the device.

The device may be mechanically raised via the actuation at step 408. The actuation may be completed to place the user in a seated position at step 410, or responsive to a secondary user input received at step 412, the actuation may continue to raise the user from the seated position to an at least substantially standing position. Needless to say, upon departing of the person from physical association with the device, the device may be returned, such as by reverse actuation of the actuator, to its original, compressed position at step 414.

Those of ordinary skill in the art will recognize that many modifications and variations of the present invention may be implemented without departing from the spirit or scope of the invention. Thus, it is intended that the present invention cover the modification and variations of this invention provided they come within the scope of the appended claims and their equivalents.

What is claimed is:

1. A device for transferring a user from a substantially horizontal, substantially floor-level position to at least a seated position, comprising:

a substantially stable base having a substantially horizontal profile in the range of less than 6 inches above floor level;

an upper frame having at least a portion thereof movably mounted atop said base, comprising:

a lower most portion capable of accommodating an area of legs of the user, with a length of a first end of the lower most portion pivotally connected to the base at a first hinge;

a seat portion capable of at least partially accommodating a bottom of the user, and pivotally associated across at least a portion of a length of a first end of the seat portion with an adjacent length of a second end of the lowermost portion at a second hinge; and a backrest portion, having a first end and a second end, capable of at least partially accommodating a back of the user, the backrest portion pivotally associated across at least a portion of a length of the first end with the base at a third hinge and pivotally associated with an adjacent length of a second end of the seat portion across at least a portion of a length of the backrest portion between the backrest first and second ends at a fourth hinge;

at least one actuator capable of raising, solely responsive to actuation of said actuator by a controller, at least the lowermost portion and the backrest portion to positions substantially perpendicular to and above a length of said base.

2. The device of claim 1, wherein:

a motorized arm of the actuator extends from an actuator base and engages the lower most portion between the first end and the second end of the lower most portion so that upon extension of the motorized arm, the lower most portion and the seat portion pivot about the second hinge and the second end of the lower most portion and the seat portion rise from the base.

3. The device of claim 2, wherein, the backrest portion rises as the seat portion rises in a coordinated motion.

4. The device of claim 1, wherein the base includes a locking mechanism to provide stability upon actuation of the controller.

5. The device of claim 1, further comprising a power source to power the one or more actuators.

* * * * *